US006098503A

United States Patent [19]

Hlinka

[11] Patent Number: 6,098,503

[45] Date of Patent: Aug. 8, 2000

[54] STICK FILE WRENCH

[76] Inventor: John A. Hlinka, 633 Gatlin Rd., Benton, Ky. 42025

[21] Appl. No.: 09/251,628

[22] Filed: Feb. 17, 1999

[51] Int. Cl.[7] ..... B25B 13/00

[52] U.S. Cl. ..... 81/124.3; 81/121.1; D8/28

[58] Field of Search ..... 81/119, 121.1, 81/124.3, 125.1; D8/28, 29

[56] References Cited

U.S. PATENT DOCUMENTS

| | | | |
|---|---|---|---|
| D. 274,404 | 6/1984 | Adler . | |
| D. 329,178 | 9/1992 | Ackermann . | |
| D. 410,179 | 5/1999 | Hsieh | D8/28 |
| 651,574 | 6/1900 | Meredith | 81/124.3 |
| 920,717 | 5/1909 | Bellows | 81/124.3 |
| 1,378,160 | 5/1921 | Woodville | 81/124.3 |
| 1,870,612 | 8/1932 | De Schebeko | 81/124.3 |
| 1,954,141 | 4/1934 | Miquelon | 81/124.3 |
| 2,769,360 | 11/1956 | Cottrell et al. | 81/124.3 |
| 2,984,135 | 1/1961 | Collett . | |
| 3,868,873 | 3/1975 | Evans | 81/119 |
| 3,931,749 | 1/1976 | Evans | 81/119 |
| 5,259,281 | 11/1993 | Burke | 81/124.3 |

*Primary Examiner*—David A. Scherbel
*Assistant Examiner*—Joni B. Danganan
*Attorney, Agent, or Firm*—Carrithers Law Office; David W. Carrithers

[57] ABSTRACT

A long, slender tool for tightening and loosening elongated hex-head nuts (wing knobs) associated with vertical filing clamps. The tool includes an elongated hexagon shaped hole located on one end which cooperatively engages a corresponding shaped elongated hex-head nut (wing knob). A plastic coated handle is use to provide leverage in applying torque to the elongated hex-head nut (wing knob). At the opposite end of the wrench is a common hexagon shaped hole for loosening and tightening a 5/16" hex-head nut. Located closer to the elongated hexagon shaped hole than to the common hexagon shaped hole is a vertical offset.

5 Claims, 4 Drawing Sheets

STICK FILE WRENCH

BACKGROUND OF THE INVENTION

1. Technical Field

This invention relates to hand tools, specifically to such tools which are used for tightening and loosening elongated hex-head nuts (wing knobs) for vertical plan filing clamps as manufactured by Plan Hold Corp., Stacor Corp., and Safco Corp.

2. Description of Prior Art

Architects, engineers, designers, and draftspersons use vertical plan filing clamps, which are also called stick files, to hold together and hang several full size plan drawings. The clamping mechanisms for these vertical plan files are adjusted by two to three elongated hex-head nuts (wing knobs). The elongated hex-head nut (wing knob) is tapered from top to bottom, such that the top is smaller than the bottom. The nut (knob) transitions to a round shoulder at its base. The shoulder diameter is smaller than the width of the nut (knob). As the torque on these nuts (knobs) is increased, the clamping force on the group of drawings is also increased. The clamp is designed to hold up to one hundred drawings and the nut (knob) is intended to be tightened and loosened with one's bare hands.

When more than thirty drawings are to be held by the file clamp, the required nut (knob) torque to hold the drawings in place is greater than the available torque delivered by an average man. To achieve the minimum torque to adequately clamp thirty or more drawings, many people use a pair of scissors with the handle placed over the nut (knob) to provide leverage. The practice of using scissors usually leads to failure of the scissors and/or physical injury to the individual. A pair of pliers or a crescent wrench has also been used. However, due to the loose fit over the unusual shape of the elongated hex-head nut (wing knob), the chromium finish of the nut is damaged and the corners are stripped. Another disadvantage of using a pliers or a crescent wrench is that these tools are more suited for other uses. Therefore, they rarely remain near the plan filing clamp for future use.

Conventional tools known in the art have been proposed to closely fit the elongated hex-head nut (wing knob). Both of these tools consist of two metal pieces which are welded together. The first is cut with an acetylene gas torch from flat stock carbon steel with a steel rod welded to its side. The second is a torch cut socket with a t-handle welded to its top. The method of gas torch cutting leaves many burs and sharp edges. Both designs are unattractive and expensive to manufacture.

Other types of tools designed for other uses maybe used for tightening and loosening the elongated hex-head nut (wing knob), such as U.S. Pat. Nos. 2,984,135 by Collett; D329,178 by Ackerman; and D274,404 by Adler; however, these designs damage the elongated hex-head nut (wing knob) because they do not closely fit the unique shape of the nut (knob). Moreover, they consist of more than one piece and are expensive to manufacture.

Occasionally, the plastic version of the elongated hex-head nut (wing knob) breaks due to over torquing leaving an exposed bare 5/16" common hex-head nut. None of the above tools satisfactory fit the 5/16" nut; therefor, a second tool is required to loosen this nut.

SUMMARY OF THE INVENTION

The present invention defines a long, slender tool for tightening and loosening elongated hex-head nuts (wing knobs) associated with vertical filing clamps. An elongated hexagon shaped hole is located on one end of the wrench and fits over a similarly shaped elongated hex-head nut (wing knob). A plastic coated handle is use to provide leverage in applying torque to the elongated hex-head nut (wing knob). The body is of uniform cross section consisting of material of sufficient strength to allow several foot pounds of torque to be applied to the receiving nut. At the opposite end of the wrench is a common hexagon shaped hole for loosening and tightening a 5/16" hex-head nut. Located closer to the elongated hexagon shaped hole than to the common hexagon shaped hole is a vertical offset.

Further objects and advantages are to provide a tool which can be used easily and conveniently to tighten and loosen the special and unique elongated hex-head nut (wing knob) associated with vertical filing clamps, without damage to the nut, and a common 5/16" hex-head nut, with a vertically offset handle coated in plastic, which is simple to use and inexpensive to manufacture, which will most likely remain near the drawing file because of its unique design.

Accordingly, besides the objects and advantages of the stick file wrench described in the present invention, several objects and advantages of the present invention are:

(a) to provide a tool which can tighten and loosen the elongated hex-head nut (wing knob) of the vertical plan filing clamp with minimal physical effort;

(b) to provide a tool which closely fits over the elongated hex-head nut (wing knob) so that use of the tool will not damage the nut;

(c) to provide a handle which is vertically offset from the plane that receives the elongated hexagon hole, such that one's knuckles will not be injured during operation of the tool;

(d) to provide an attractive and practical handle with a plastic coating in various colors which will provide comfort and protection to the operator;

(e) to provide a tool which can be manufactured in one piece, thereby eliminating the cost of welding;

(f) to provide one tool which will fit both the elongated hex-head nut (wing knob) and a 5/16" common hex-head nut; and (g) to provide a tool of unique purpose such that it will most likely remain near the vertical filing clamp and be accessible for future use.

BRIEF DESCRIPTION OF THE DRAWINGS

A better understanding of the present invention will be had upon reference to the following description in conjunction with the accompanying drawings in which like numerals refer to like parts throughout the several views and wherein.

SPECIFICATION

The stick file wrench 10 of the present invention is manufactured from readily available materials and simple in design. The preferred embodiment is comprised of metal, more particularly carbon steel, stainless steel, aluminum, brass, or synthetic materials such as fiberglass, nylon, wood, or graphite material may be substituted for or used in combination with metal. It is contemplated that other materials may also be used for fabrication of the tool 10. The preferred embodiment is composed of ASTM 304 stainless steel because of its ability to resist corrosion and its natural luster. The weight of the steel wrench 10 is approximately 0.28 pounds. Although, the weight of the wrench 10 is not critical to its operation, a wrench 10 of lesser weight such as one fabricated from wood, plastic, or aluminum would not be as pleasing to use.

Figure 1:
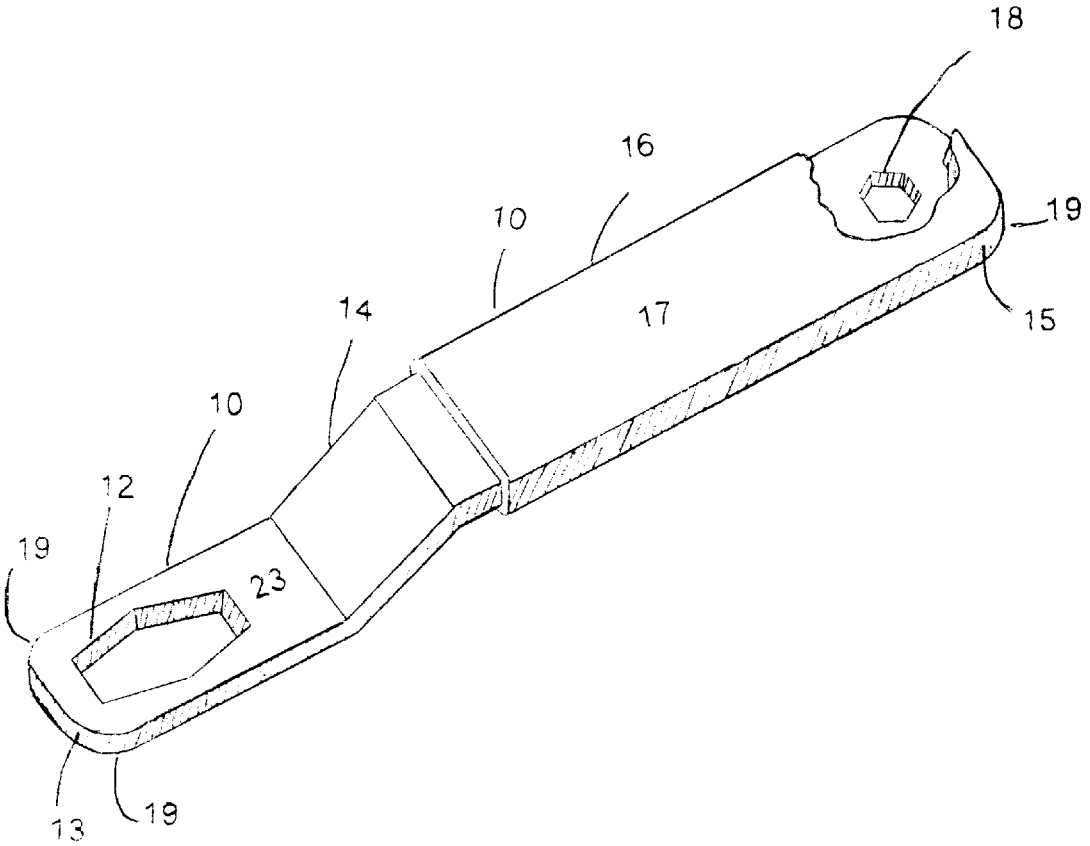
FIG. 1 shows a perspective view showing a stick file wrench with a cut-away view in the plastic coated handle to show the 0.3438 inch hexagon shaped hole.
Figure 2:
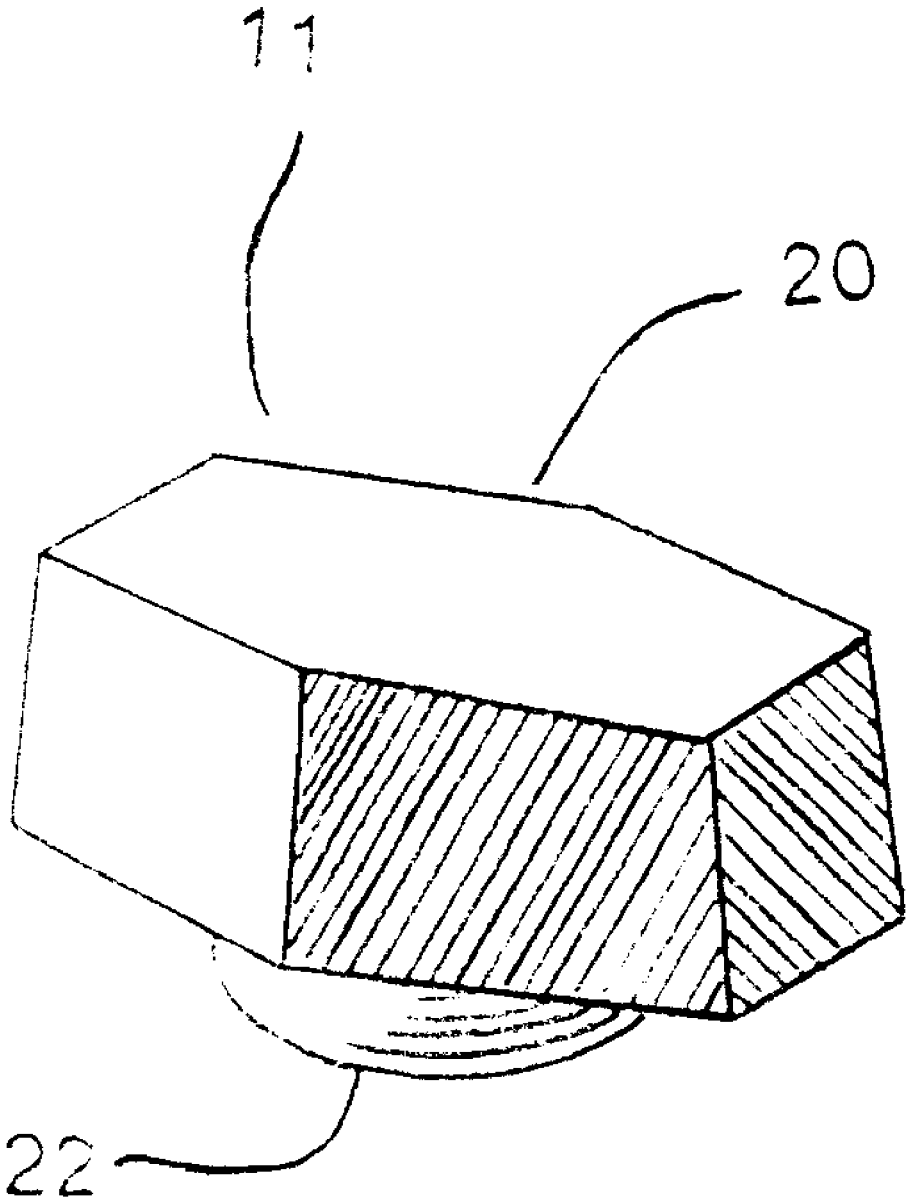
FIG. 2 is a perspective view showing a hexagon shaped nut in associated with vertical filing clamps.
Figure 3:
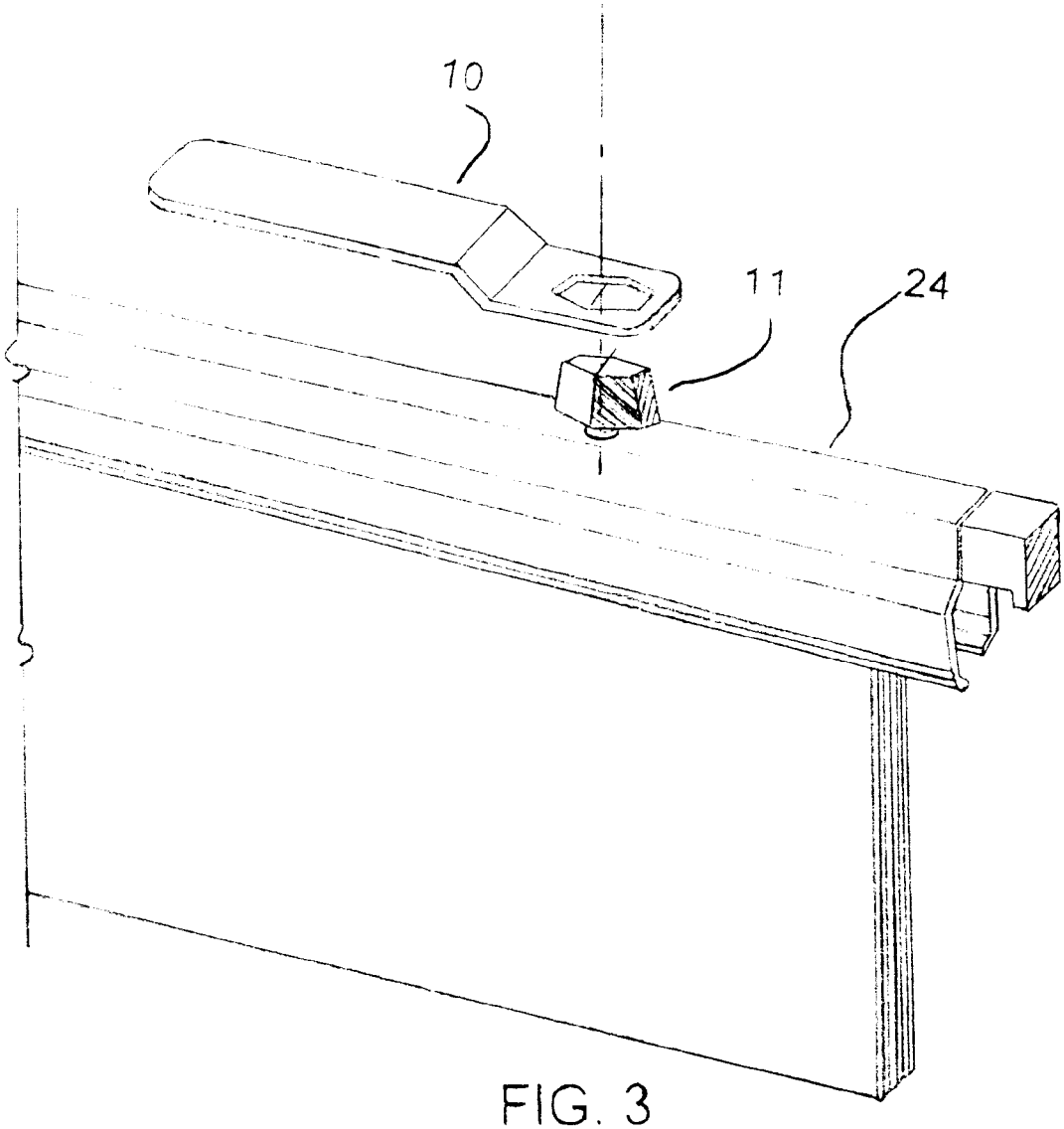
FIG. 3 is a perspective view showing a vertical file and the clamping mechanisms associated therewith for removably securing these vertical plan files, wherein the present invention is shown for adjusting the elongated hex-head nuts (wing knobs)
Figure 4:
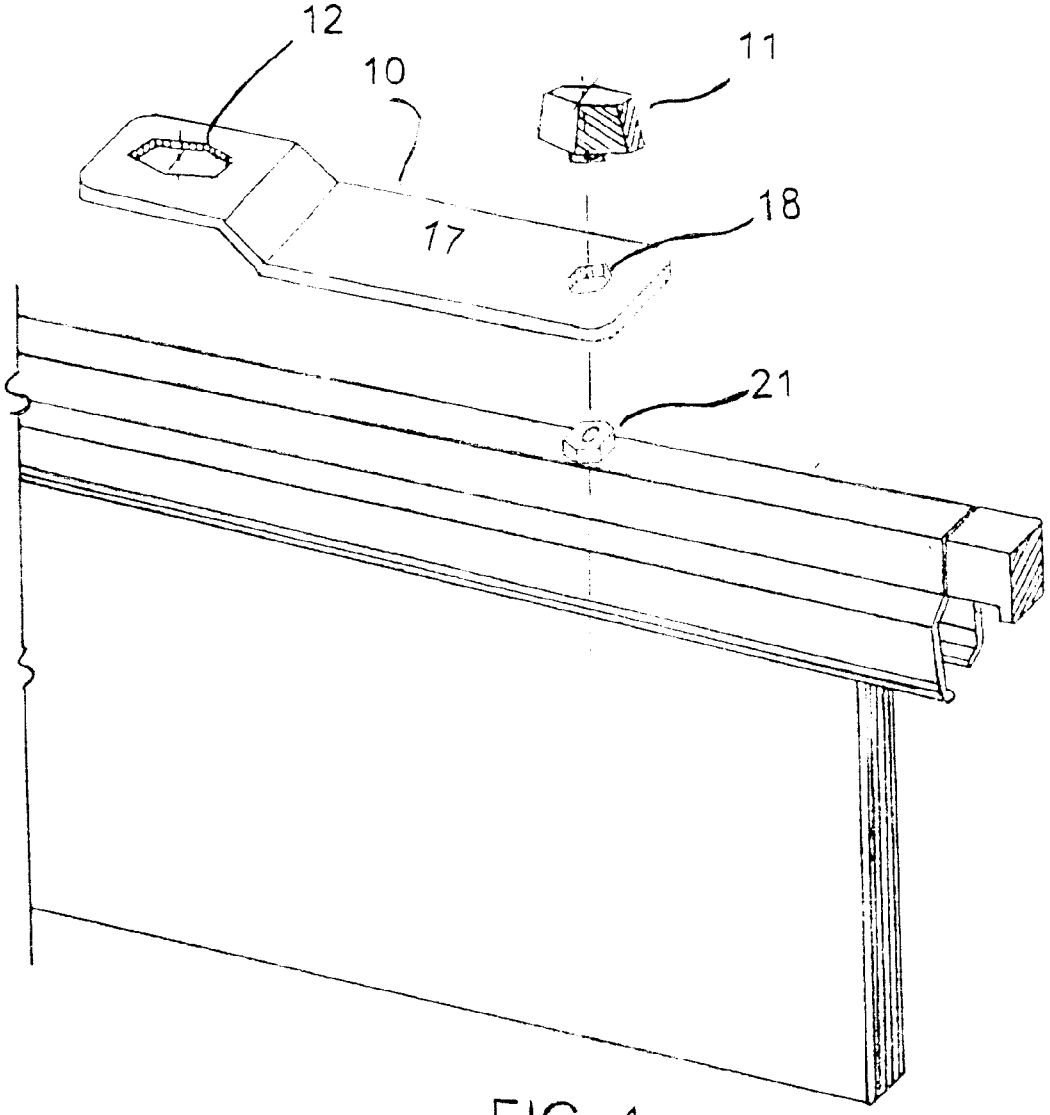
FIG. 4 is a perspective exploded view showing a vertical file and the clamping mechanisms associated therewith for removably securing these vertical plan files, wherein the present invention is shown for adjusting the elongated hex-head nuts (wing knobs) and showing the 5/16" common hex-head nut for cooperative engagement therewith.

Referring now to the drawings, FIGS. 1–4 refer to the present invention. A typical embodiment of the stick file wrench 10 of the present invention is best shown in FIG. 1 having a longitudinal member defining a slender body of uniform cross section consisting of a material of sufficient strength to allow several foot-pounds of torque to be applied to a receiving nut 11.

At a first end 13 of the wrench 10 is an elongated hexagon shaped hole 12 which is slightly larger than the top of a tapered, elongated hex-head nut (wing knob) 11 and slightly smaller than the bottom of the elongated, tapered hex-head nut (wing knob) 11. At the opposite second end 15 of the wrench 10 defining a handle 16 having a plastic coating 17 is a common 0.3438 inch hexagon shaped hole 18. This 0.3438 inch hexagon shaped hole 18 is typically covered with plastic and is only slightly visible. The handle 16 is coated with plastic 17, which adheres to the wrench base material. The plastic handle 16 is suited very well for providing an advertising surface adapted for screen printing of logos, artwork, and/or other advertising. In the preferred embodiment the coating is thermal-set plastisol, and is available in various colors. However, it is contemplated that the coating can consist of other materials such as an air-set plastisol, latex, epoxy, etc. The wrench 10 includes an angled vertical offset forming a step 14 located closer to the elongated hexagon shaped hole 12 at the first end 13 than to the common hexagon shaped hole 18 at the second end. The angle is from about 5 to about 45 degrees and preferably from about 10 to about 20 degrees. The upper portion of the offset constitutes the handle 16. The lower portion of the wrench 10 at the first end 13 receives the elongated hex-head nut (wing knob) 11.

The wrench 10 of the preferred embodiment is typically about 0.125 inches in thickness, about 7.875 inches long, and about 1.00 inch wide. The lower flat portion with the elongated hexagon shaped hole 12 is about 2.00 inches long. The offset dimensions are roughly 0.50 inches vertically and 0.875 inches horizontally. The handle 12 is approximately 5.00 inches long. The corners 19 of the wrench 10 are cut on a 0.25 inch radius. The length of the elongated hexagon shaped hole 12 is 1.0938 inches, and the width from point to point is 0.5625 inches, and the width at both ends is 0.3125 inches. The dimensions of the common hexagon shaped hole 18 are 0.3438 inches from flat surface to flat surface. The center line of both holes 12, 18 are located on the center line of the wrench 10. The coating 16 is about 70 mils to about 100 mils in thickness.

The preferred method of fabrication for the embodiment is flat laser cutting, then press brake forming, and then tumbling and deburring. All edges are smooth and free of burrs. Other methods of fabrication are, but are not limited to, press punching, plasma cutting, wire cutting, forging and pressure injection molding.

Many variations of this wrench configuration are possible. For instance, the lower flat portion 23 can be increased in length and the common hexagon shaped hole 18 can be relocated to the lower flat portion next to the elongated hexagon shaped hole 12. The overall length and width of the wrench 10 can vary as well as the dimensions of the elongated hexagon shaped hole 12. The elongated hexagon shaped hole 12 is slightly larger than the top of the elongated hex-head nut (wing knob) 11 and slightly smaller than the bottom of the elongated hex-head nut (wing knob) 11, such that the elongated hexagon shaped hole 12 passes over the top of the elongated hex-head nut (wing knob) 11, yet not past the bottom of the elongated hex-head nut (wing knob) 11.

From the description above, a number of advantages of my stick file wrench are evident:

(a) The stick file wrench 10 can conveniently and easily tighten and loosen the elongated hex-head nut (wing knob) 11 of the vertical plan filing clamp;

(b) The stick file wrench 10 closely fits over the elongated hex-head nut (wing knob) 11 so that use of the tool 10 will not damage the nut 11;

(c) The stick file wrench 10 provides a handle 16 which is vertically offset, from the plane that receives the elongated hexagon hole 12, such that one's knuckles will not be injured during operation of the tool 10;

(d) The stick file wrench 10 provides a handle 16 with a plastic coating in various colors which will provide comfort and protection to the operator;

(e) The stick file wrench 10 can be manufactured in one piece, thereby eliminating the cost of welding;

(f) The stick file wrench 10 will fit both the elongated hex-head nut (wing knob) 11 and a 5/16" common hex-head nut 21;

(g) The stick file wrench 10 is so unique that it will most likely remain near the vertical plan filing clamp and be accessible for future use.

To use the wrench 10, first grasp the stick file wrench 10 by the handle 16, then the elongated hexagon shaped hole 12 is placed over the elongated hex-nut (wing knob) 11. The elongated hex-nut (wing knob) 11 is tapered, such as the top of the nut (knob) 11 is smaller than the bottom. The hole 12 is larger than the top of the nut (knob) 11 and smaller than the bottom of the nut (knob) 11, such that the hole 12 will not pass beyond the nut (knob) 12. Once the hole 12 comes in snug contact with the nut (knob) 11, the stick file wrench 10 is used as a lever to tighten and/or to loosen the nut (knob) 11.

In the event that the elongated hex-head nut (wing knob) inadvertently breaks, the common hex-hole 18 can be opened by removing a small portion of the coating 16 by peeling away the plastic coating or forming a hole therethrough. Then the hexagon shaped hole 18 is placed over the remaining 5/16" hex-head nut 21. The opposite end of the stick file wrench 10 now becomes the handle and is used as a lever to apply torque for tightening and loosening the 5/16" nut 21. The occurrence of wing knob breakage is very rare. For aesthetic reasons the hexagon shaped hole 18 is concealed beneath the coating 16.

Accordingly, the stick file wrench 10 can be used easily and conveniently to tighten and loosen the special and unique elongated hex-head nut (wing knob) 11 associated with vertical filing clamps, also known as stick files, without damage to the nut 11, and a common 5/16" hex-head nut 21, with a vertically offset handle 16 coated in plastic various colors, which is simple to use and inexpensive to manufacture, which will most likely remain near the drawing file because of its unique design.

It is contemplated that stick file wrench 10 can have other shapes besides the longitudinal configuration such as a circular, trapezoidal, or triangular arrangement. Moreover, the size and shape of the holes can vary in accordance with the shape of the nut to be tightened or untighted. The location and number of the engageable holes can vary wherein a plurality of holes can be formed in one tool. The invention can also be adapted to form a socket having a hole corresponding sized and shaped for cooperative engagement with the hex nut 11 for removable engagement with a ratchet tool.

The foregoing detailed description is given primarily for clearness of understanding and no unnecessary limitations are to be understood therefrom, for modifications will become obvious to those skilled in the art based upon more recent disclosures and may be made without departing from the spirit of the invention and scope of the appended claims.

I claim:

1. A tool for loosening or tightening at least one elongated hex-head nut, at least one elongated wing knob, or a hex nut of at least one vertical filing clamp of a vertical plan file or a stick file, comprising:

a longitudinal member having a first end including a first elongated hexagon shaped hole therethrough having a plurality of smooth sidewalls, and a second end including a second hexagon shaped hole therethrough having a plurality of smooth sidewalls of equal distance, said first elongated hexagon shaped hole being of a larger diameter than said second hexagon shaped hole, said longitudinal member including a central portion connecting said first end and said second end, said central portion extending from said first end and said second end at angles forming an offset step thereinbetween defining an upper portion and a lower portion of said longitudinal member, wherein said upper portion of said longitudinal member constitutes a handle and said elongated hexagon shaped hole on said lower portion of said longitudinal member receives said at least one elongated hex-head nut, or said at least one elongated wing knob.

2. The tool of claim 1, wherein at least a portion of said longitudinal member includes a coating.

3. The tool of claim 1, wherein said smooth sidewalls of said first elongated hexagon shaped hole are tapered for cooperatively engaging said at least one elongated hex-head nut or at least one elongated wing knob at a selected position.

4. The tool of claim 1, wherein said offset step is formed having an angle of from about 5 to about 45 degrees.

5. The tool of claim 1, wherein said offset step is formed having an angle of from about 10 to about 20 degrees.

* * * * *